United States Patent [19]

Fleissner

[11] Patent Number: 4,462,226

[45] Date of Patent: Jul. 31, 1984

[54] APPARATUS FOR SUPPORTING A ROLL LOOPED AROUND BY A TEXTILE MATERIAL

[75] Inventor: Heinz Fleissner, Egelsbach, Fed. Rep. of Germany

[73] Assignee: Vepa AG, Riehen, Switzerland

[21] Appl. No.: 302,616

[22] Filed: Sep. 15, 1981

[30] Foreign Application Priority Data

Sep. 19, 1980 [DE] Fed. Rep. of Germany ..... 3035383

[51] Int. Cl.[3] ..... D06B 3/12; D06B 23/04

[52] U.S. Cl. ..... 68/5 D; 226/119

[58] Field of Search ..... 68/5 D, 5 E; 34/157; 226/119

[56] References Cited

U.S. PATENT DOCUMENTS 3,109,572 11/1963 Herr ..... 226/119 X

FOREIGN PATENT DOCUMENTS 446990 3/1948 Canada ..... 226/119

543018 2/1932 Fed. Rep. of Germany ..... 68/5 D

*Primary Examiner*—Philip R. Coe

*Attorney, Agent, or Firm*—Antonelli, Terry & Wands

[57] ABSTRACT

An apparatus for supporting a guide roll horizontally within a steamer or like housing wherein the roll is looped partially from the bottom by a length of textile material. The apparatus includes means for suspending the roll at each of its ends via support means that extend through the ceiling of the housing. These support means are vertically controllable to be raised and lowered as required.

5 Claims, 4 Drawing Figures

APPARATUS FOR SUPPORTING A ROLL LOOPED AROUND BY A TEXTILE MATERIAL

This invention relates to an apparatus for supporting a roll which roll is looped around partially from the bottom by a textile good, such as a length of carpet material, and is arranged, in particular, in a festoon steamer (progressing loop-type steamer) in the lower row of two rows arranged in superimposed, spaced relationship.

Treatment devices are conventional wherein a length of material, e.g., textile material or carpet material, is guided in controlled material transport in a meander shape about rolls arranged at constant mutual spacings; furthermore, devices, especially steamers, are known for the fixation of dyes applied to the length of carpet material, which devices are distinguished by the feature that the material is guided in the steamer in only unilaterally supported progressing loops to prevent any pressure loads on the visible side provided with the dye and also on the pile. For this purpose, guide or deflecting rollers are arranged in the upper zone of a housing, which are rotatably supported and revolve in a driven fashion, the progressing loops hanging freely over these rollers. The length of the respective traveling loops is determined by scanning elements which regulate the drive of the subsequent guide roller in dependence on the thus-determined loop length.

One problem in such steamers, as compared with a device with controlled guidance of material, is the flawless travel of the length of material through the housing. Such travel becomes difficult in the formation of the curvature of the traveling loops in the lower reversing zone. If the radius formed at that location is nonuniform over the width of the length of material, then a crease is immediately produced over the height of the traveling loop, preventing the further transport of the material in this loop and thus in the entire steamer.

It is known from DOS [German Unexamined Laid-Open Application] No. 2,128,159 to utilize a channel accommodating the entire lower arc of the traveling loop for forming the lower loop curvature, this channel extending over the width of the web of material. The channel can simultaneously be used also as a scanning element. It has been found under practical conditions that such a channel for forming the loop curvature does not operate satisfactorily in case of all lengths of material. To ensure troublefree operation, it is thus furthermore known in case of textile materials having a less sensitive pile to additionally arrange a guide roller inside the lower loop, which, according to DOS No. 2,325,572 can also be supported at the end faces of a channel which preforms the curvature of the length of material.

Such a deflection of the length of material at the lower reversal point in a steamer ensures an absolutely necessary, secure transport of the material and also the regulation of the loop length, but it cannot be satisfactory in the final analysis, because, on the one hand, the channel has a relatively large weight with the great operating breadth of 5 m, and, on the other hand, the channel as well as the roller must be arranged in the steamer to be rotatable and capable of moving up and down. Although the bearings for allowing rotation initially operate satisfactorily, these bearings become quickly contaminated by dyestuffs and thickeners so that repeated cleaning is necessary for the bearings required to effect movement of the roller and of the channel. Since this can only be carried out when the machine is shut down, cooled, and thus free of steam, this involves in all cases a relatively long idle period for such a steamer.

The invention is based on the object of finding a solution for avoiding contamination of a support arrangement for suspending the lower guide roll (or roller), which roll must be constructed in such a way that it exerts no pressure at all or only an extremely minor pressure on the visible side of the length of material and that additionally the support arrangement especially the bearing surfaces are not exposed to any contamination by the agents present in the device, such as dyes, thickeners, or steam.

Starting with the apparatus of the type described hereinabove, the above objective has been attained by providing that the guide roll is suspended at the ends by a suspension means located outside of the steamer. This means includes suspension devices extended through the ceiling of the housing, and that are supported at that location to be vertically controllable. This suspension arrangement eliminates all problems. The support structures of installations necessary for supporting the roll are now advantageously disposed outside of the steam atmosphere, so that the installations can no longer be contaminated, either. Also, it is thus possible to equip these installations with an improved bearing with a material and with ball bearings, which cannot operate for an extended time period within the steam atmosphere.

It is especially advantageous to design the suspension device as a flexible cable and to extend this cable vertically at the top through a tubular guide duct through the ceiling of the housing, this duct being only slightly larger in diameter than the cable. It is simple to fashion this duct in a steam-tight construction, although there is no appreciable friction between the upwardly and downwardly movable cable and its guide duct.

In a further development of the device according to this invention, the cable is connected with a pressure piston-cylinder unit arranged on the ceiling of the housing, this unit being operable hydraulically or pneumatically. With the aid of this unit, the guide roll suspended in the steamer can be entirely unstressed over the entire duration of operating the steamer and yet the guide roll can fulfill its function, namely to effect the exact guidance of the length of material in the zone of the steamer floor.

The drawing shows an embodiment of the apparatus according to the invention. Additional details of this invention will be explained below with reference to the drawing wherein.

Figure 2:
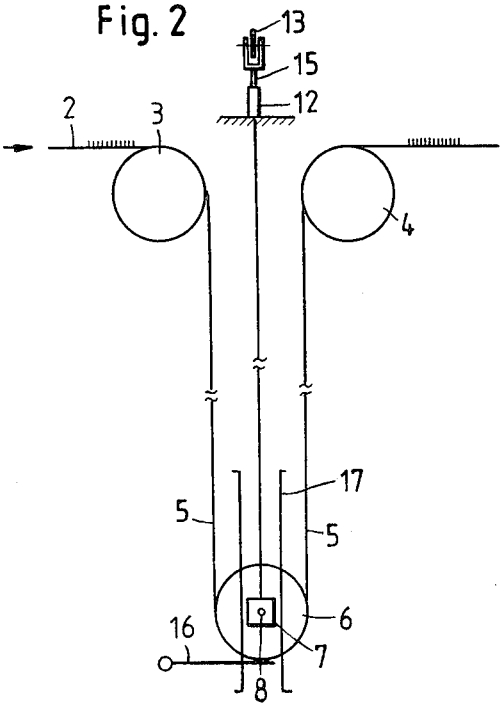
FIG. 2 shows a traveling loop with the roll in a frontal end view.
Figure 3:
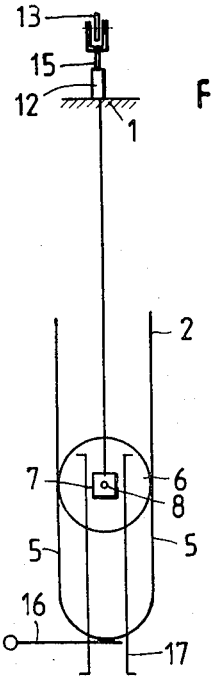
FIG. 3 is an end view like FIG. 2 showing a different positional arrangement of the roll.

Numeral 1 denotes the housing of a steamer, through which a length of material 2 is guided in traveling loops. FIGS. 2 and 3 show merely one of these loops by way of example. For guiding the length of carpet material 2, entering with the pile side oriented toward the outside, guide rollers 3, 4 are arranged in the zone of the ceiling of the steamer, between which such a traveling loop 5 is suspended. In order to effect an exact guidance of the length of material in the lower deflection zone, a guide roll 6 is arranged within the traveling loop 5, the weight of this roll being completely relieved, i.e., supported.

The apparatus to accomplish this desired roll support consists of a guide plate 7 rotatably mounted via a lower bearing 8 to the trunnion 9 of the roll 6. A cable 10 is attached at the top to the guide plate 7 and extends vertically upwardly through the housing wall 1 in a tubular guide duct 11. Above the housing, a pulley 13 is rotatably mounted on a pressure piston-cylinder unit 12; the cable is placed over this pulley and after looping around same by 180° is extended downwardly again and fastened to the housing 1 at point 14. Depending upon the extent to which the piston 15 of unit 12 has been moved out of the cylinder, the cable pulley 13 is more or less lifted and with it also the roll 6, by double the height. This block and tackle arrangement and attachment of the cable 10 has the advantage that, with a small movement of the piston 15 of unit 12, a larger movement of the guide roll 6 is effected. It will be recognized that a similar suspension arrangement or system is provided at the other end of the roll.

The cable 10 can be plastic-coated and can be extended through the likewise coated, tubular duct 11 in such a way that the steam present in the steamer under normal pressure will hardly exit through this duct. Depending upon requirements, the guide roll 6 can be arranged in a greatly lifted position in the traveling loop 5, the length of which remains unchanged, as shown in FIG. 3; consequently, no pressure at all is exerted on the pile in the lower deflection zone of the length of material 2. It is also possible to maintain the roll 6 loosely just on the bottom within the traveling loop 5, for example with a weight of one kilogram being applied over its entire length to the length of carpet material. This weight can be raised up to the full weight of the guide roll. As is customary, the length of the traveling loop 5 is determined by a feeler 16 controlling via a potentiometer, the revolving speed of the subsequent guide roll 4. During the upward and downward movement of the roll 6, the roll is held in a perpendicular guide means 17 via the plate 7.

The pressure piston-cylinder unit 12 can be operated hydraulically or pneumatically; optionally, it can also be replaced by an electric motor. Each unit can be separately equipped with a controller for the metered feeding of compressed air or the like, so that any desired alignment of the roll 6 is possible to affect the path of the traveling material.

Figure 1:
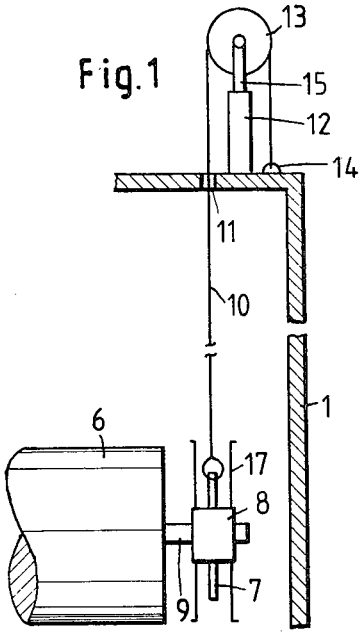
FIG. 1 is a section taken through a steam treatment device in the zone of the suspension arrangement for one end of a roll.
Figure 4:
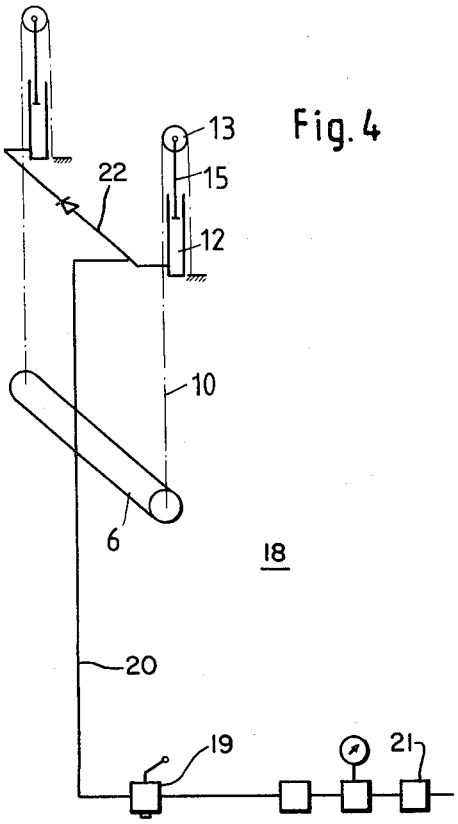
FIG. 4 is a schematic view illustrating the control means for regulating and controlling operation of the suspension arrangement for the guide roll.

In FIG. 4 a control arrangement 18 for feeding compressed air to the pressure piston cylinder units 12 at each end of the roll 6 includes can actuator valve 19 in feed conduit 20 and a source of compressed air 21. Conduit 20 is connected to a distribution line 22 for introducing the compressed air into units 12.

What is claimed is:

1. An apparatus for supporting a guide roll horizontally which roll is looped around partially from the bottom by a length of textile material and is arranged in a housing of a festoon steamer, said apparatus comprising means for suspending the guide roll at each of its ends, the suspension means including a cable that is extended through the ceiling of the housing and that is supported at that location to be vertically controllable, a pressure-actuated piston cylinder unit, a rotatable guide pulley supported on the piston, and a guide plate arranged at each end of the guide roll; said cable being attached to said guide plate, being looped around the top of the pulley and then being fastened to the housing whereby vertical upward movement of the piston causes the cable to lift an end of the guide roll; said guide plate being guided vertically by means for providing a vertically extending track located within said housing.

2. An apparatus according to claim 1, wherein the support means comprises a flexible cable which is extended vertically through a tubular duct through the ceiling of the housing, in a substantially steam-tight fashion, said duct being only slightly larger in diameter than the cable.

3. An apparatus according to claim 1, wherein the pressure piston-cylinder unit is operated hydraulically or pneumatically.

4. An apparatus according to claim 1, wherein said guide plate is rotatably mounted to said guide roll.

5. An apparatus according to claim 1, further comprising control means for feeding compressed air to the pressure piston cylinder units at each end of the guide roll.

* * * * *